US012292203B2

(12) United States Patent
Sarimurat et al.

(10) Patent No.: US 12,292,203 B2
(45) Date of Patent: May 6, 2025

(54) COMPACT, HIGH-EFFICIENCY AIR HANDLING UNIT FOR RESIDENTIAL HVAC SYSTEMS

(71) Applicants: Mehmet Nasir Sarimurat, Fayetteville, NY (US); Thong Quoc Dang, East Syracuse, NY (US)

(72) Inventors: Mehmet Nasir Sarimurat, Fayetteville, NY (US); Thong Quoc Dang, East Syracuse, NY (US)

(73) Assignee: SYRACUSE UNIVERSITY, Syracuse, NY (US)

( * ) Notice: Subject to any disclaimer, the term of this patent is extended or adjusted under 35 U.S.C. 154(b) by 0 days.

(21) Appl. No.: 17/621,725

(22) PCT Filed: Jul. 1, 2020

(86) PCT No.: PCT/US2020/040411
§ 371 (c)(1),
(2) Date: Dec. 22, 2021

(87) PCT Pub. No.: WO2021/003211
PCT Pub. Date: Jan. 7, 2021

(65) Prior Publication Data

US 2022/0243739 A1 Aug. 4, 2022

Related U.S. Application Data

(60) Provisional application No. 62/869,172, filed on Jul. 1, 2019.

(51) Int. Cl.
*F24F 1/0022* (2019.01)
*F04D 17/06* (2006.01)
(Continued)

(52) U.S. Cl.
CPC ..... *F24F 1/0022* (2013.01); *F04D 17/06* (2013.01); *F04D 29/444* (2013.01);
(Continued)

(58) Field of Classification Search
CPC .... F04D 17/06; F04D 29/703; F04D 29/5826; F04D 29/444; F24F 1/0022;
(Continued)

(56) References Cited

U.S. PATENT DOCUMENTS 4,428,715 A * 1/1984 Wiggins ..... F02C 3/08 415/199.2
5,743,710 A * 4/1998 Yapp ..... F04D 17/165 415/208.2
(Continued)

FOREIGN PATENT DOCUMENTS

DE 102012019419 A1 * 4/2014
JP 2823657 B2 * 11/1998
(Continued)

OTHER PUBLICATIONS

English machine translation of WO-2012/017478-A1, Mar. 27, 2023.*
(Continued)

*Primary Examiner* — Christopher Verdier
(74) *Attorney, Agent, or Firm* — David L. Nocilly; Bond Schoeneck & King PLLC

(57) ABSTRACT

An air handler unit for use with residential heating, ventilation, and air conditioning (HVAC) systems. The air handler unit has high resistance mediums (HRMs) coupled closely to a wide-angle vane-diffuser mixed-flow fan system. The HRMs are placed immediately upstream and downstream of the wide-angle vane-diffuser mixed-flow fan to form a closely coupled, compact air handler that provides significant efficiency and noise benefits.

8 Claims, 18 Drawing Sheets

(51) Int. Cl.

| | |
|---|---|
| ***F04D 29/44*** | (2006.01) |
| ***F04D 29/46*** | (2006.01) |
| ***F04D 29/58*** | (2006.01) |
| ***F04D 29/70*** | (2006.01) |
| ***F24F 1/0059*** | (2019.01) |
| ***F24F 1/0063*** | (2019.01) |
| ***F24F 1/0073*** | (2019.01) |
| ***F24F 1/028*** | (2019.01) |
| ***F24F 1/0287*** | (2019.01) |
| ***F24F 1/035*** | (2019.01) |
| ***F24F 1/38*** | (2011.01) |
| ***F24F 13/20*** | (2006.01) |
| ***F24F 13/28*** | (2006.01) |
| ***F24F 13/30*** | (2006.01) |

(52) U.S. Cl.
CPC ..... *F04D 29/462* (2013.01); *F04D 29/584* (2013.01); *F04D 29/703* (2013.01); *F24F 1/0059* (2013.01); *F24F 1/0063* (2019.02); *F24F 1/0073* (2019.02); *F24F 1/028* (2019.02); *F24F 1/0287* (2019.02); *F24F 1/035* (2019.02); *F24F 1/38* (2013.01); *F04D 29/5826* (2013.01); *F24F 2013/205* (2013.01); *F24F 13/28* (2013.01); *F24F 13/30* (2013.01)

(58) Field of Classification Search
CPC ..... F24F 1/0063; F24F 1/0059; F24F 1/028; F24F 1/0287; F24F 2013/205; F24F 13/28; F24F 13/30; F24F 1/035; F24F 1/0073; F24F 1/38
See application file for complete search history.

(56) References Cited

U.S. PATENT DOCUMENTS

| | | | | |
|---|---|---|---|---|
| 8,092,154 | B2 * | 1/2012 | Jarrah | F04D 29/5866 415/116 |
| 2017/0102007 | A1 * | 4/2017 | Stauter | F04D 29/542 |
| 2019/0078580 | A1 * | 3/2019 | Chen | F04D 25/08 |
| 2019/0154042 | A1 * | 5/2019 | Chang | F04D 29/526 |
| 2021/0285686 | A1 * | 9/2021 | Park | F04D 29/281 |

FOREIGN PATENT DOCUMENTS

| | | | |
|---|---|---|---|
| KR | 10-2014-0015945 | A * | 2/2014 |
| WO | WO-2012/017478 | A1 * | 2/2012 |

OTHER PUBLICATIONS

English machine translation of KR-10-2014-0015945-A, Aug. 25, 2023.*
English machine translation of DE-102012019419-A1, Aug. 25, 2023.*
English machine translation of JP-2823657-B2, Aug. 25, 2023.*

* cited by examiner

AIR FLOW PATH

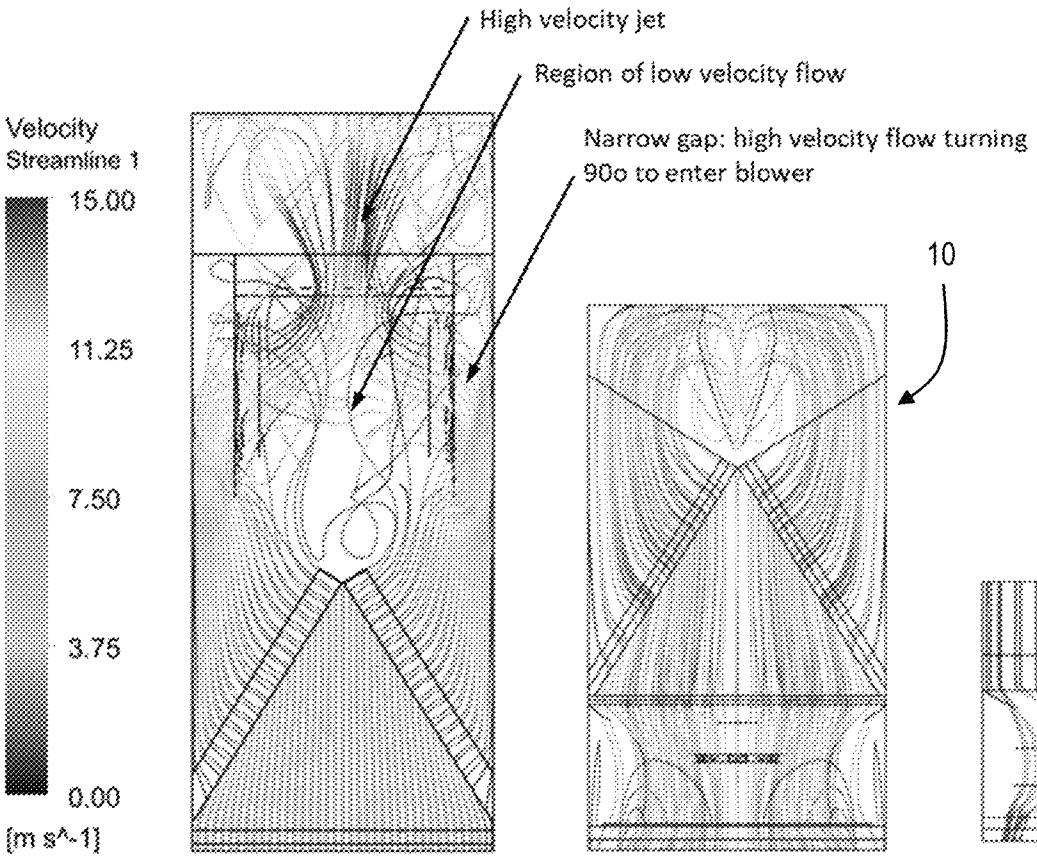
PRIOR ART
FIG. 10A
FIG. 10B
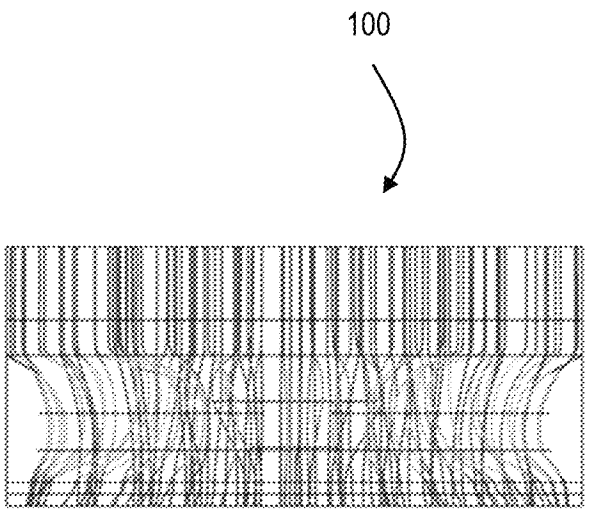
FIG. 10C

COMPACT, HIGH-EFFICIENCY AIR HANDLING UNIT FOR RESIDENTIAL HVAC SYSTEMS

CROSS-REFERENCE TO RELATED APPLICATIONS

The present application claims priority to U.S. Provisional Application No. 62/869,172 filed on Jul. 1, 2019, hereby incorporated by reference in its entirety.

STATEMENT REGARDING FEDERALLY SPONSORED RESEARCH

This invention was made with government support under Grant No. DE-SC0019977 awarded by the U.S. Department of Energy. The government has certain rights in the invention.

BACKGROUND OF THE INVENTION

1. Field of the Invention

The present invention relates to heating, ventilation, and air conditioning (HVAC) systems and, more specifically, to an air handling unit having a wide-angle vane-diffuser mixed-flow fan system positioned very close and between high resistance flow mediums for improved efficiency and performance in a residential HVAC system.

2. Description of the Related Art

A conventional residential HVAC system has an air handling unit that is physically connected to the ventilation system of the home. For air conditioning, the air handling unit works in connection with an outdoor unit to provide comfort to its occupants. In colder climates, the air handling unit usually comprises a furnace that runs on natural gas. For milder climate, the air handling unit may be a heat pump or a fan coil unit with or without an electrical heater. The major components of the air handler unit are a blower and one or more high resistance mediums (HRMs). In a furnace, the HRMs can comprise a primary heat exchanger (burner), a secondary heat exchanger, a cooling coil, and a filter. In the case of heat pumps and fan coil units, the HRMs are the filter and the heat exchanger (condenser/evaporator coil).

The common design practice in HVAC industry is to optimize the components inside an air handler unit as standalone components and then combine the individually designed components into a housing. For example, the blower used in almost every air handler unit on the market is a double-inlet, forward curved centrifugal fan having a static efficiency of about 40 percent. These fans have been preferred for decades because commercially available, cost-effective electronically commutated motors (ECM) could only run up to a maximum speed of 1050 RPM. At this RPM, only forward curved fans can meet the required duty in terms of pressure rise and volume flow rate. In addition, forward curved blowers have better sound level and sound quality properties compared to other high efficiency fan types (e.g. backward curved fans, mixed flow fans, vane axial fans). Only recently have high efficiency, cost-effective ECM motors that can run at higher speeds up to 2000 RPM been introduced into rooftop units with the air-management system having a vane-axial fan. While these units are more efficient because of the use of a vane-axial fan with ECM, however, the components inside these units are optimized as standalone components, and they do not take the advantage of synergetic coupling between components.

BRIEF SUMMARY OF THE INVENTION

The present invention comprises an air handler design having HRMs coupled closely with a wide-angle vane-diffuser mixed-flow fan system, with the HRMs placed immediately upstream and downstream of the wide-angle vane-diffuser mixed-flow fan system. The resulting combination is a closely coupled, compact air handler that provides significant efficiency and noise benefits. In one embodiment, the compact assembly for an air handling unit comprises a mixed-flow fan having a rotor with a plurality of blades to move air from an upstream side of the mixed-flow fan to a downstream side, a wide-angle diffuser having a plurality of vanes coupled to the downstream side of the mixed-flow fan, a first high resistance media coupled directly to the upstream side of the mixed-flow fan and positioned no farther than a first predetermined distance from the plurality of blades; and a second high resistance media coupled directly to the diffuser and positioned no further than a second predetermined distance from the plurality of vanes. The first predetermined distance may be no more than fifteen percent of a mean chord of the plurality of blades. The second predetermined distance may be no more than five percent of a mean chord of the plurality of vanes. The diffuser has a low hub-to-tip ratio. The diffuser has up to a 45 degree diffuser angle. The plurality of vanes of the diffuser have a diffusion factor of 0.8 or higher. The diffuser has a hub with a variable diameter. The plurality of blades of the fan may be highly loaded with diffusion factor of 0.6 or higher. The fan has a hub with a variable diameter. The first high resistance media may be selected from the group consisting of a filter and a heat exchanger. The second high resistance media may comprise a heat exchanger. The second high resistance media may be coupled directly to the diffuser by being incorporated into the plurality of vanes of the diffuser.

The present invention also comprises an air handling unit having a housing having an intake, an air flow path, and an exhaust, a mixed-flow fan having a rotor with a plurality of blades positioned in the air flow path to move air from an upstream side of the mixed-flow fan to a downstream side, a diffuser having a plurality of vanes positioned in the air flow path and coupled to the downstream side of the mixed-flow fan, a first high resistance media positioned in the air flow path and coupled directly to the upstream side of the mixed-flow fan, wherein the first high resistance media is positioned no farther than a first predetermined distance from the plurality of blades, and a second high resistance media positioned in the air flow path and coupled directly to the diffuser, wherein the second high resistance media is positioned no farther than a second predetermined distance from the plurality of vanes. The first predetermined distance may be fifteen percent of a mean chord of the plurality of blades and the second predetermined distance is five percent of a mean chord of the plurality of vanes. The first high resistance media may be a filter, and the second high resistance media may be a heat exchanger. The heat exchanger may be incorporated into the plurality of vanes of the diffuser.

BRIEF DESCRIPTION OF THE SEVERAL VIEWS OF THE DRAWING(S)

The present invention will be more fully understood and appreciated by reading the following Detailed Description in conjunction with the accompanying drawings, in which:

FIG. 10A is computer simulation showing velocity streamlines inside a baseline line air handling unit, and air handling units having a wide angle vane diffuser fan assembly according to the present invention; and FIG. 10B is computer simulation showing velocity streamlines inside a first air handling unit having a wide-angle vane-diffuser fan assembly according to the present invention;

FIG. 10C is computer simulation showing velocity streamlines inside a second air handling unit having a wide-angle vane-diffuser fan assembly according to the present invention;

DETAILED DESCRIPTION OF THE INVENTION

Figure 1A:
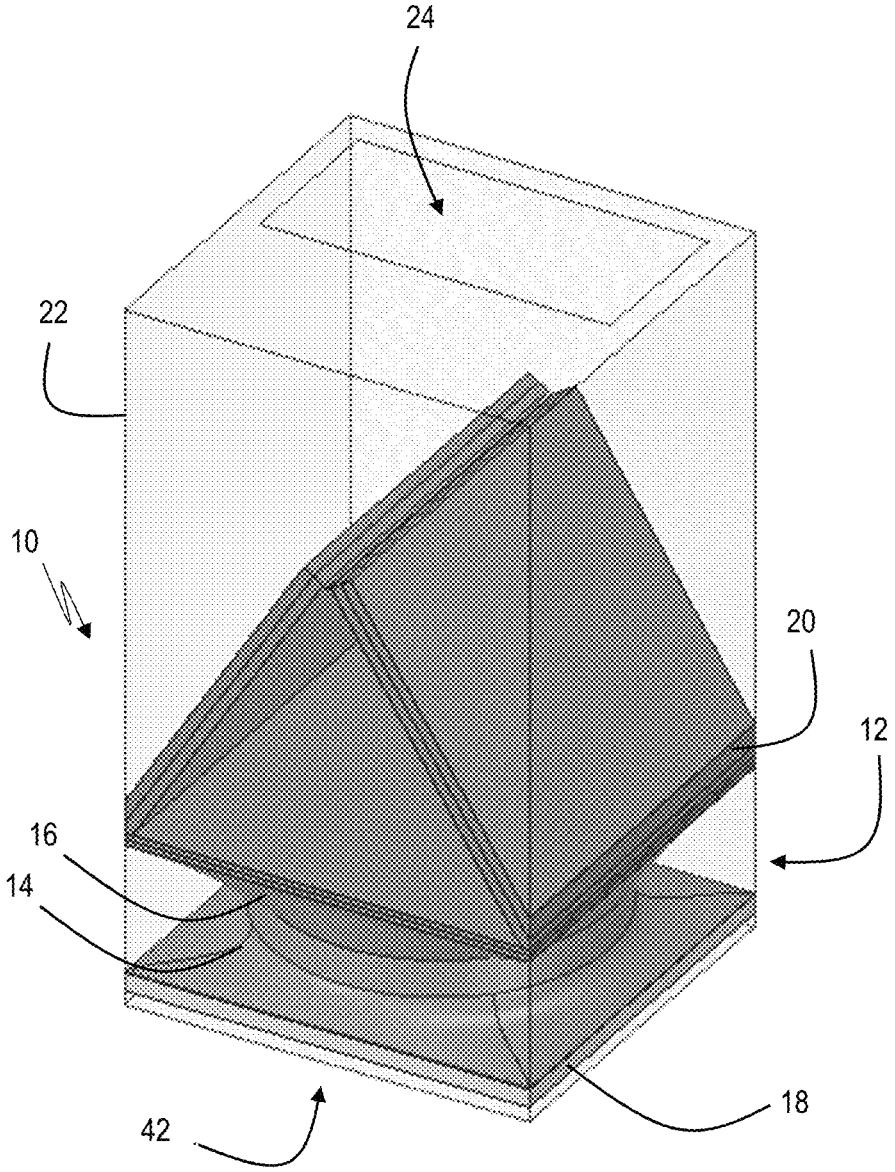
FIG. 1A is a perspective view of an air handling system with delta coil and having a wide-angle vane-diffuser fan assembly according to the present invention.
Figure 1B:
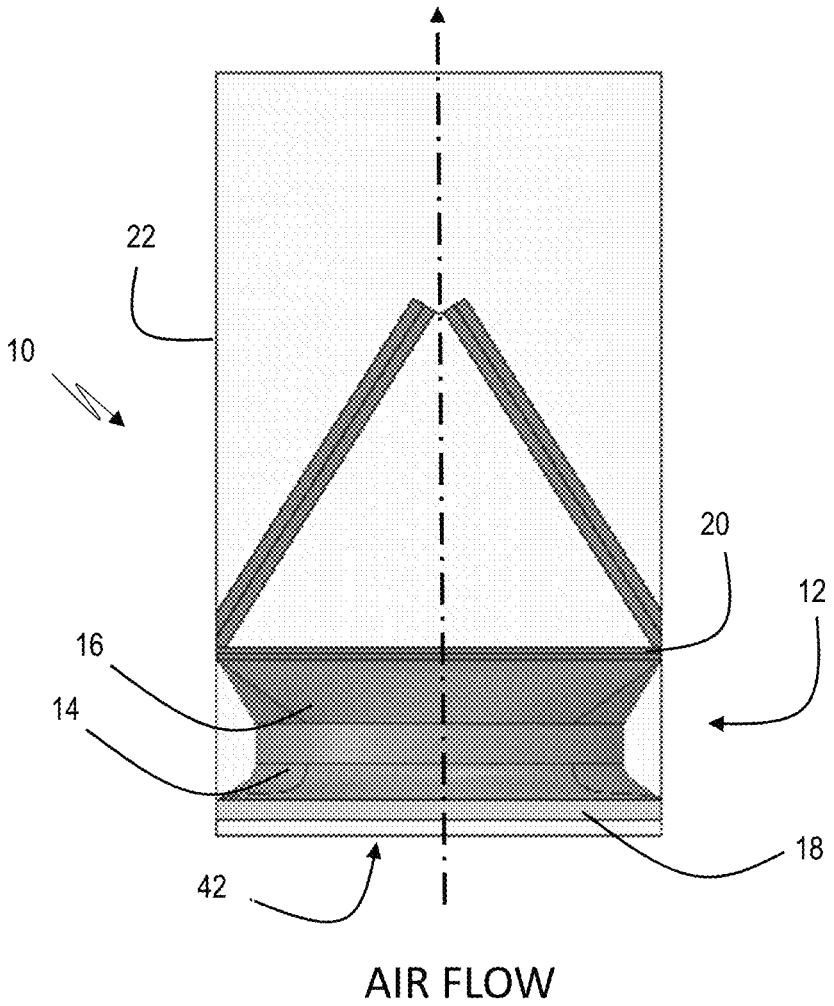
FIG. 1B is a front view of an air handling system with delta coil and having a wide-angle vane-diffuser fan assembly according to the present invention.

Referring to the figures, wherein like numerals refer to like parts throughout, there is seen in FIGS. 1A and 1B, a compact system 10 for use in air handling units that comprises a wide-angle vane-diffuser fan assembly 12 formed from a mixed-flow fan rotor 14 that is coupled to a vane diffuser 16. Compact system 10 is show in combination with a delta coil having a predetermined coil surface area.

Figure 2A:
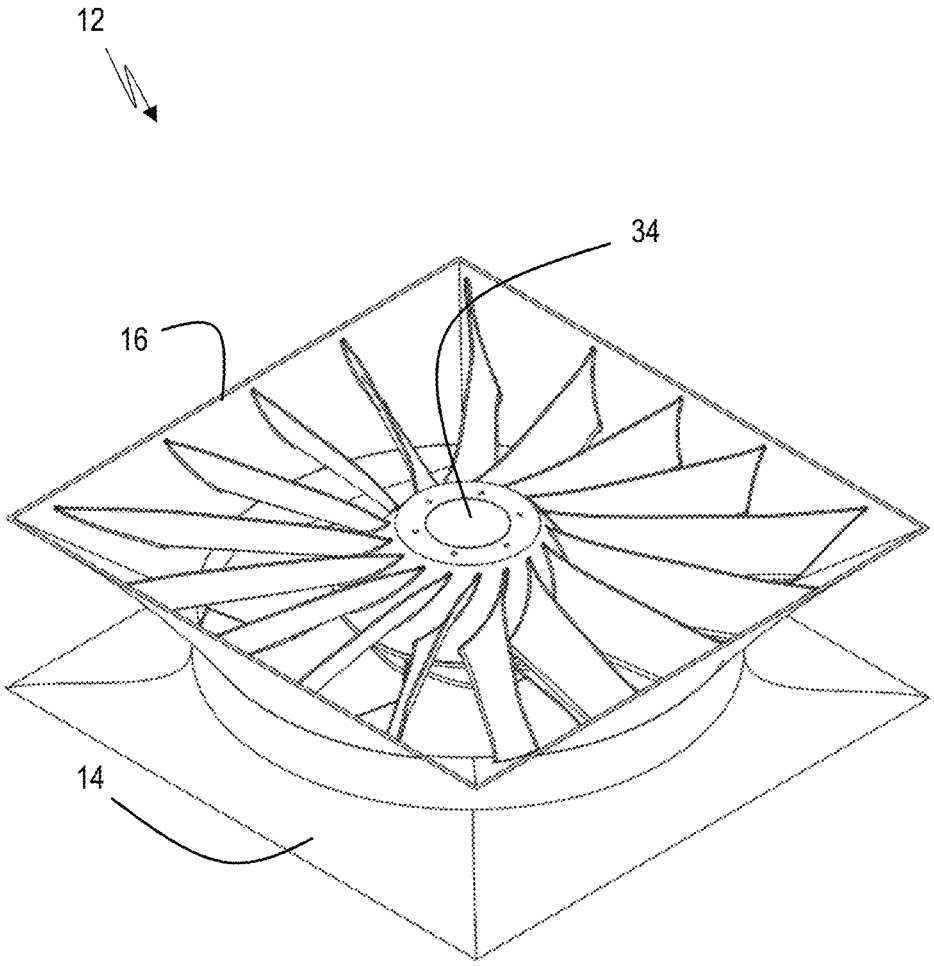
FIG. 2A is a top perspective view of a wide-angle vane-diffuser fan assembly according to the present invention.
Figure 2B:
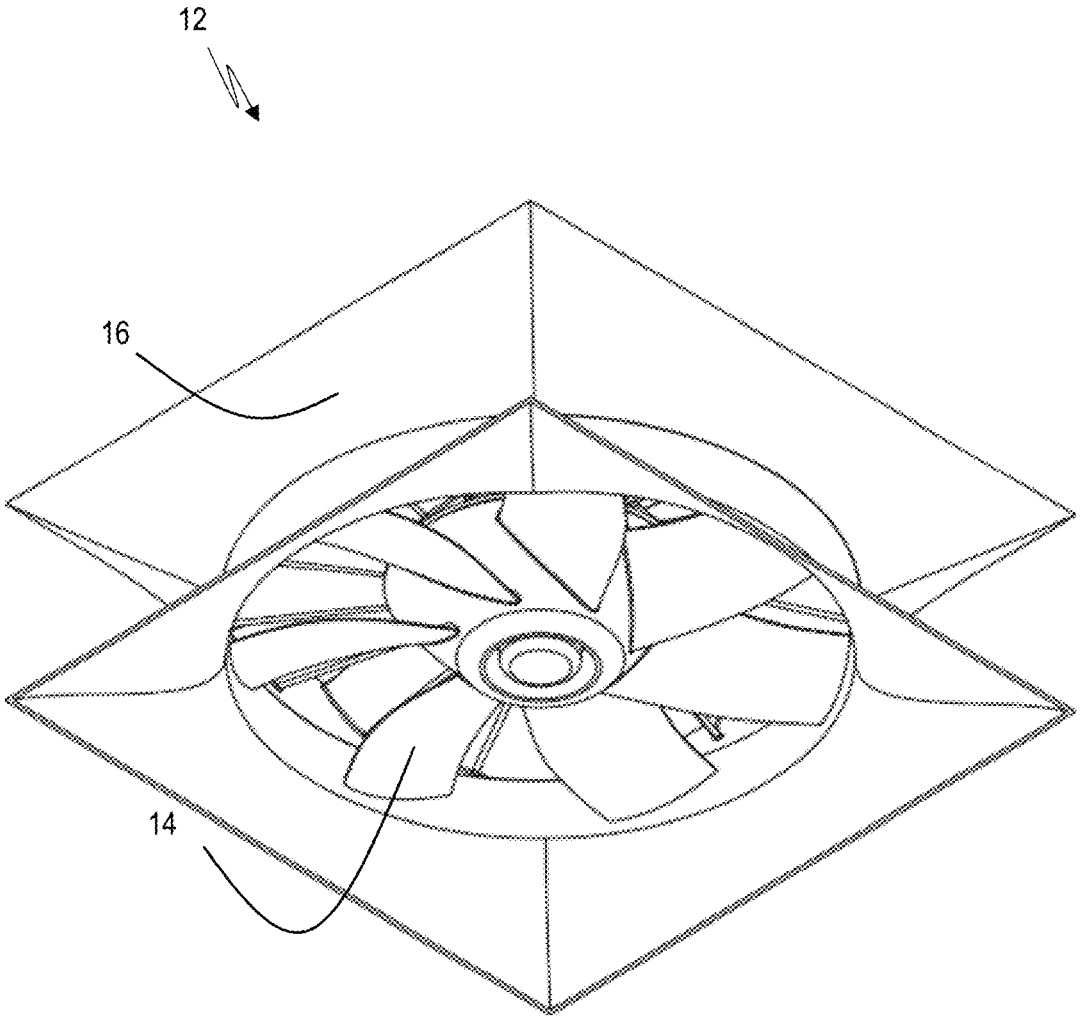
FIG. 2B is a bottom perspective view of a wide-angle vane-diffuser fan assembly according to the present invention.
Figure 2C:
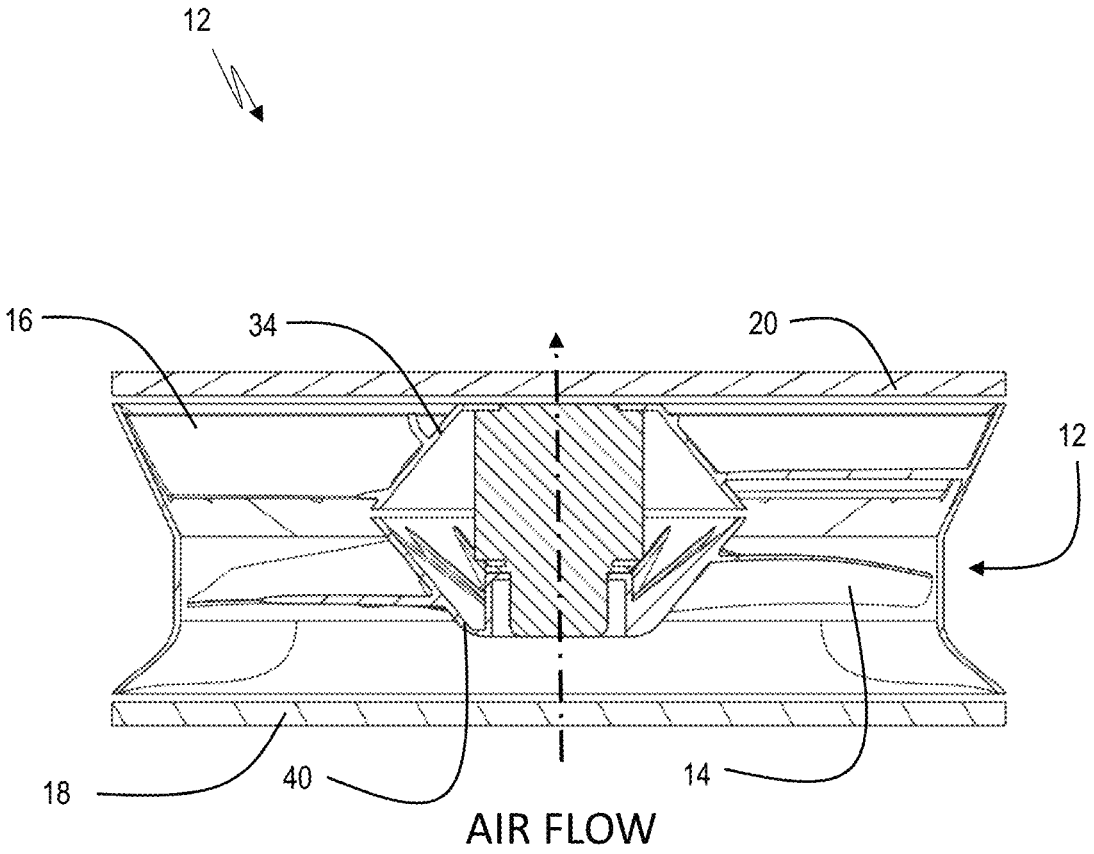
FIG. 2C is a cross-sectional view of a wide-angle vane-diffuser fan assembly according to the present invention.

Referring to FIGS. 2A through 2C, compact system 10 includes a first high resistance medium (HRM) 18 (e.g. filter, heat exchanger, etc.) coupled upstream of vane-diffuser fan assembly 12 and a second HRM 20 (e.g. filter, heat exchanger, etc.) coupled downstream of vane-diffuser fan assembly 12. High resistance mediums 18 and 20 are strongly coupled, meaning that there is a minimal gap separating high resistance mediums 18 and 20 from the mixed-flow fan rotor 14 and vane diffuser 16. System 10 is shown in FIGS. 1A and 1B as having a filter as HRM 18 and a delta shaped heat exchange coil as HRM 20 and being positioned in a housing 22 having an air flow path that extends from an intake 42 through HRM 18, vane-diffuser fan assembly 12 and delta shaped heat exchange coil as HRM 20 to an upper exhaust 24. As in known in the art, the term high resistance generally refers to a medium having a k value or factor of at least 5.0 in the formula $\Delta p = k/2pv^2$. The present invention can provide benefits with HRMs having k values of about 6.0 and above.

Figure 3:
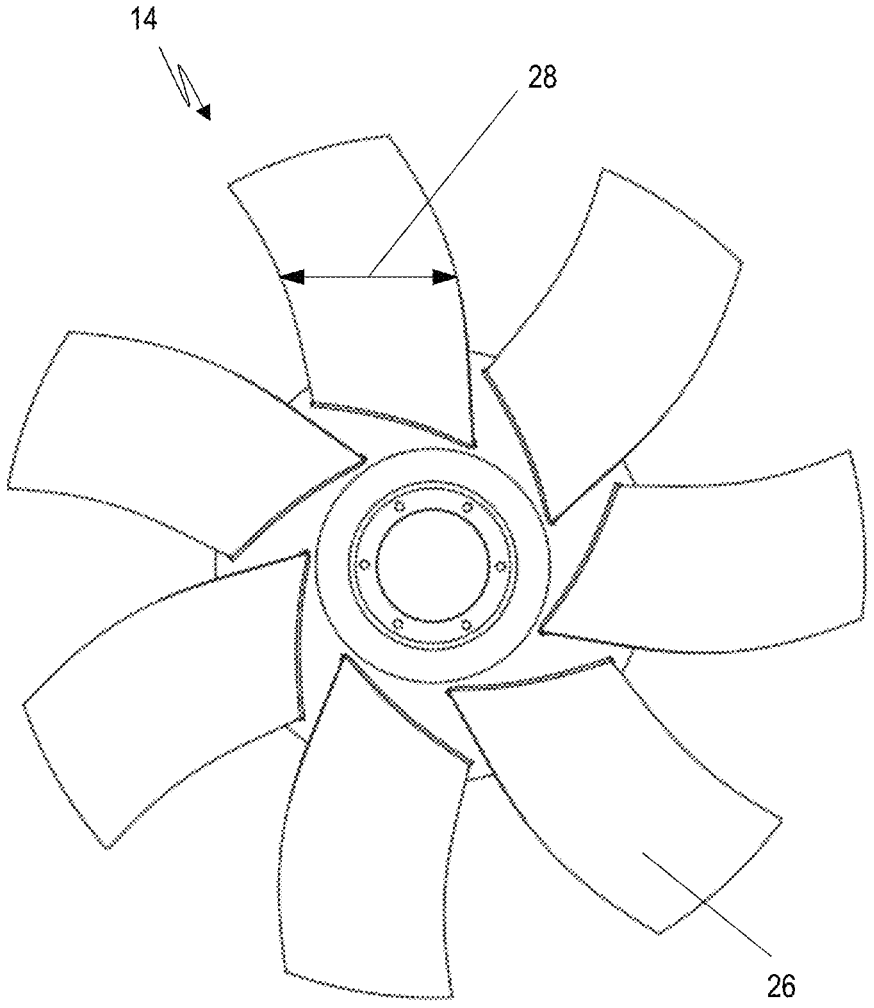
FIG. 3 is a schematic of a mixed-flow fan rotor for use in a wide-angle vane-diffuser fan assembly according to the present invention.
Figure 4:
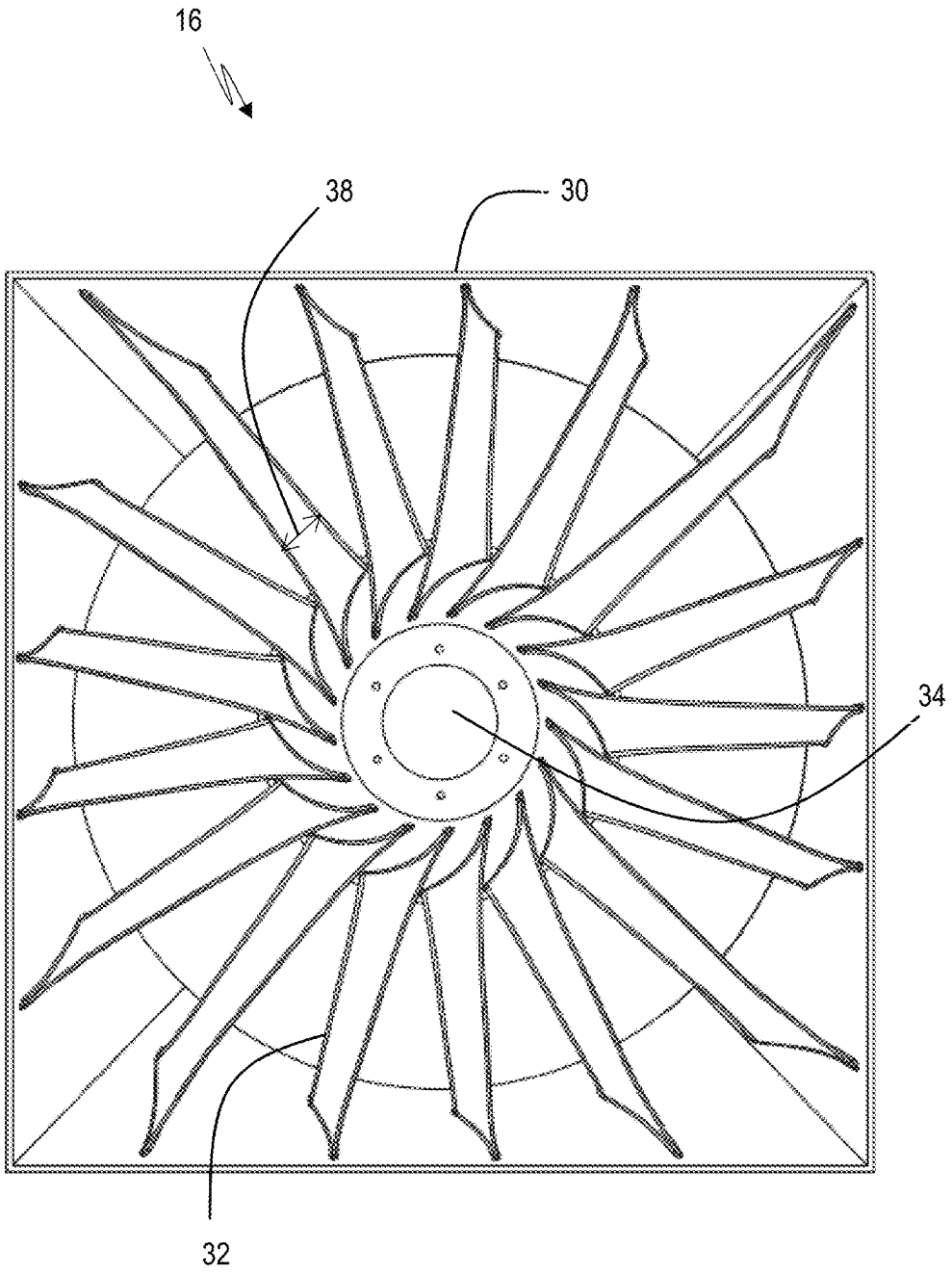
FIG. 4 is a wide-angle vane diffuser for use in a wide-angle vane-diffuser fan assembly according to the present invention.

Referring to FIG. 3, the distance between vane-diffuser fan assembly 12 and upstream HRM 18 cannot be larger than 15 percent of the mean chord 28 of the blades 26 of fan rotor 14. Similarly, as seen in FIG. 4, the distance between vane-diffuser fan assembly 12 and downstream HRM 20 cannot be larger than 5 percent of the mean chord 38 of the stator vanes of vane diffuser 16. The compact arrangement of vane-diffuser fan assembly 12, HRM 18, and HRM 20 increases the efficiency of the air handler unit and reduces the overall size (in terms of volume). For example, an air handling system 10 using a wide-angle vane-diffuser fan assembly 12 according to the present invention may be up to 15 percent more efficient as compared to the use of a conventional vane-axial fan without strong coupling to the high resistance media. With respect to the present invention, wide-angle refers to up to about 45 degrees. By comparison, conventional approaches are will stall over about 7 degrees.

Vane-diffuser fan assembly 12 is configured to benefit from the presence of upstream HRM 18 and downstream HRM 20. More specifically, as seen in FIG. 4, the stator 30 of vane diffuser 16 also has a low hub-to-tip ratio and is a high-angle diffuser with highly-loaded vanes 32 optimized or the downstream HRM 20. Conventional stators typically have a hub-to-tip ratio of about 0.7. The low hub-to-tip ratio of the present invention is about 0.5 or below, and optimally around about 0.3 for fan rotor 14 and about 0.1 for stator 30. Vane diffuser 16 may have up to and including a 45 degree diffuser angle, which provides a significant increase in pressure recovery. As seen in FIG. 3, the hub 34 of vane diffuser 16 is optimized to minimize the wake behind the stator 30 by including a variable diameter hub 34 that maximizes pressure recovery. The flow entering the downstream heat exchanger (or HRM) is uniform, resulting in minimum pressure drop and maximum heat transfer effectiveness.

Referring to FIG. 3, fan rotor 14 preferably uses highly-loaded (diffusion factor of 0.6 or higher), high-efficiency fan blades 26 to take advantage of upstream HRM 18. Conventional approaches cannot use diffusion factors above 0.5 as they result in flow separation and stalling. The present invention can accommodate diffusion factors as high as 0.8 without stalling. As seen in FIG. 2C, a variable diameter fan hub 40 allows fan rotor 14 to work as a mixed flow fan and to produce more pressure when compared to conventional axial flow fans. Optimally, fan 14 has a diffusion factor of about 0.6 or higher, and stator 20 has a diffusion factor of 0.8.

HRM 18 and HRM 20 may comprise off-the-shelf filters and heat exchangers provided they are strongly coupled to vane-diffuser fan assembly 12, as explained above.

Figure 5A:
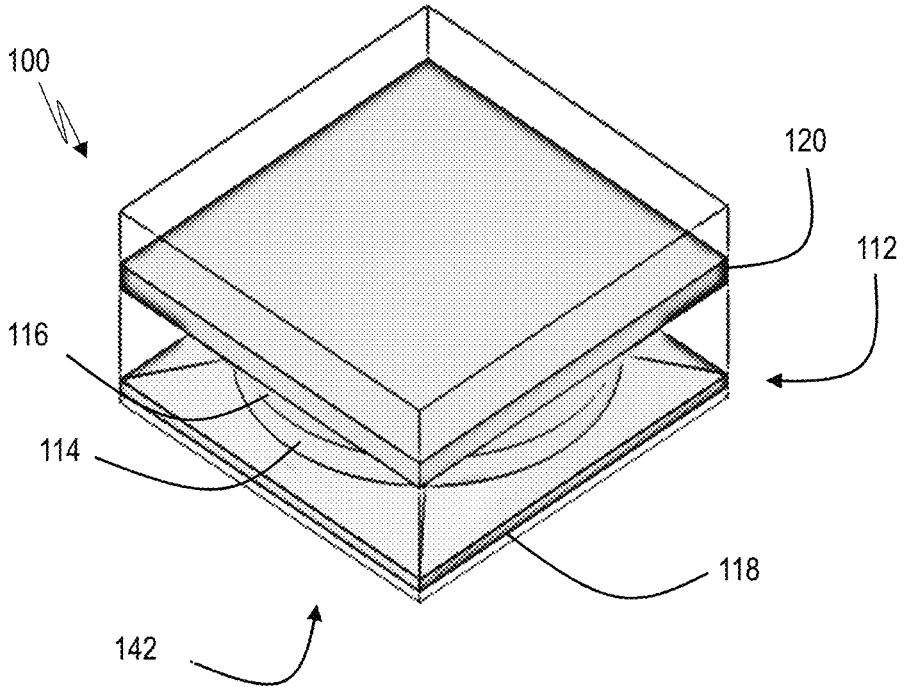
FIG. 5A is a perspective view of an air handling system with flat coil and having a wide-angle vane-diffuser fan assembly according to the present invention
Figure 5B:
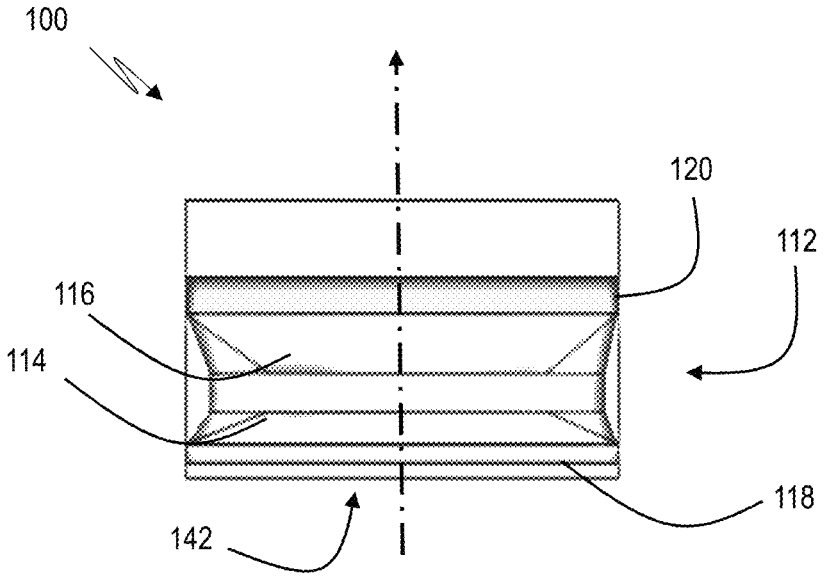
FIG. 5B is a front view of an air handling system with flat coil and having a wide-angle vane-diffuser fan assembly according to the present invention.

Referring to FIGS. 5A and 5B, another embodiment of a compact system 100 for use in air handling units comprises a wide-angle vane-diffuser fan assembly 112 formed from a mixed-flow fan rotor 114 that is coupled to a vane diffuser 116. Compact system 100 is configured for use with and shown in combination with a flat coil having the same coil surface area as the delta coil or compact system 10, albeit with a larger cross-sectional area. Compact system 100 includes a first high resistance medium (HRM) 118 (e.g. filter, heat exchanger, etc.) coupled upstream of vane-diffuser fan assembly 112 and a second HRM 120 (e.g. filter, heat exchanger, etc.) coupled downstream of vane-diffuser fan assembly 112. High resistance mediums 118 and 120 are strongly coupled, meaning that there is a minimal gap separating high resistance mediums 118 and 120 from the mixed-flow fan rotor 114 and vane diffuser 116. System 100 may be implemented in an air handling unit as shown in FIGS. 1A and 1B as in housing 22 so that the air flow path that extends from an intake 142 through HRM 118, vane-diffuser fan assembly 112 and second HRM 120 to upper exhaust 24.

Figure 6A:
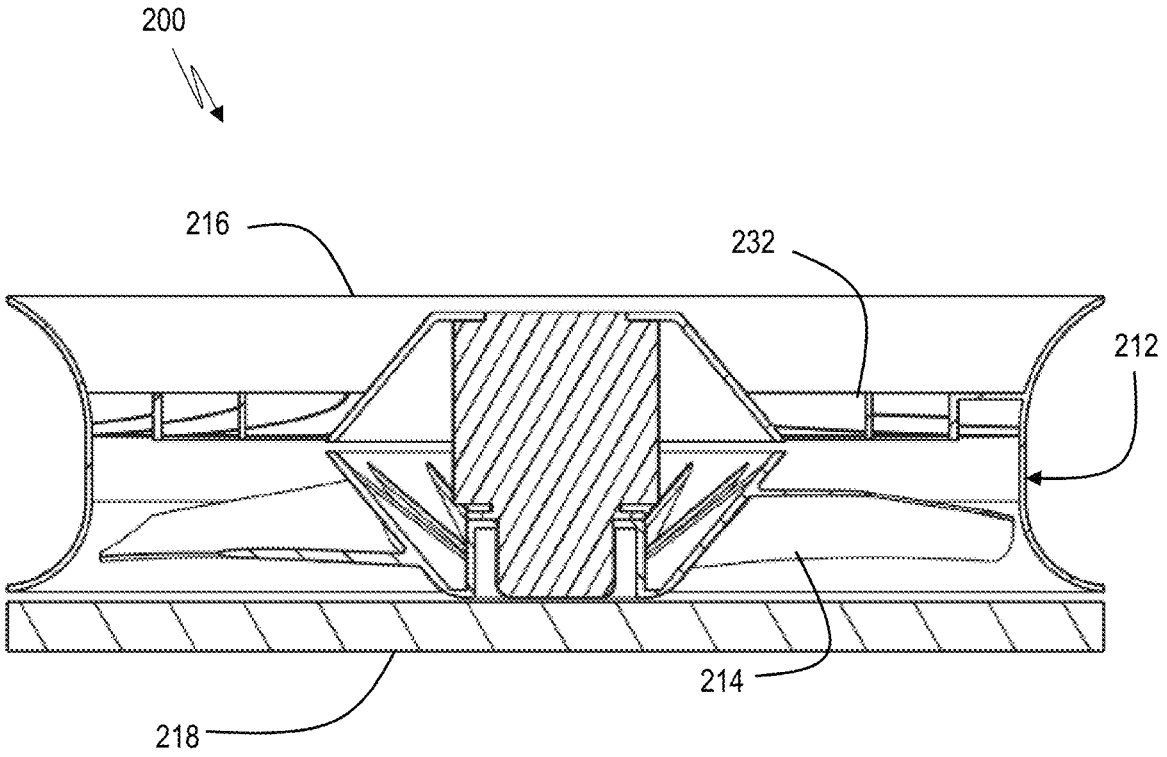
FIG. 6A is a cross-sectional view of another embodiment of a wide-angle vane-diffuser fan assembly according to the present invention.
Figure 6B:
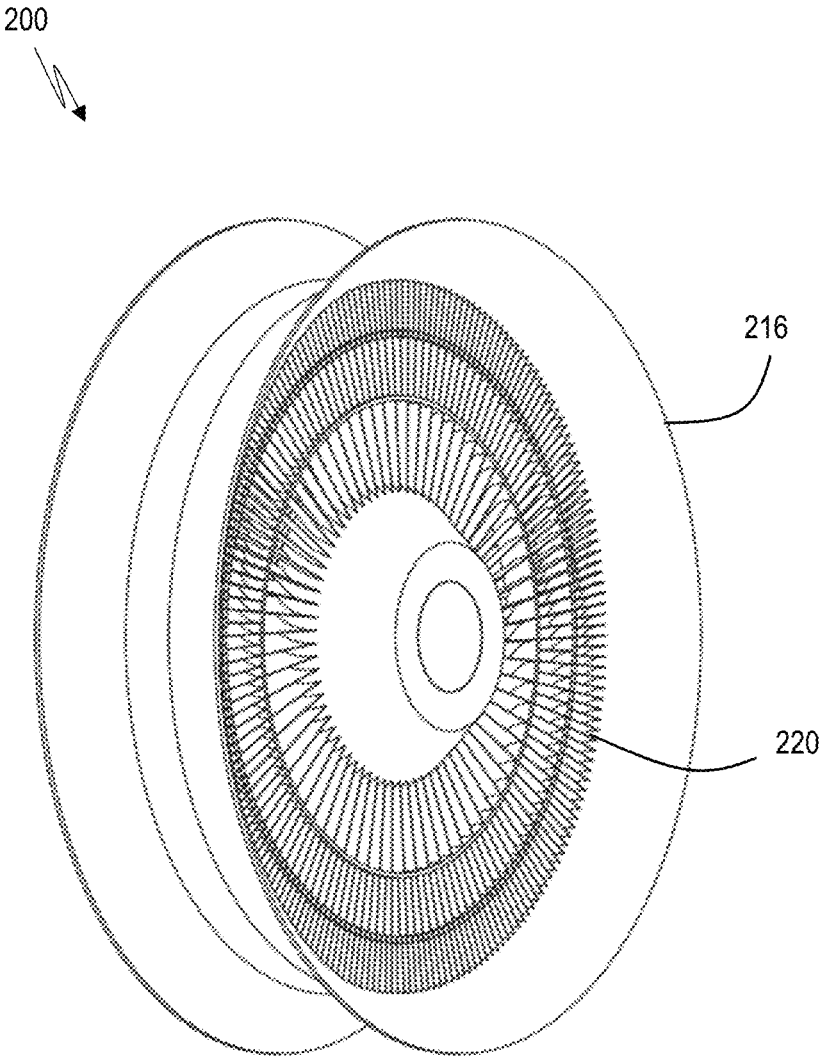
FIG. 6B is a top perspective view of another embodiment of a wide-angle vane-diffuser fan assembly according to the present invention.
Figure 6C:
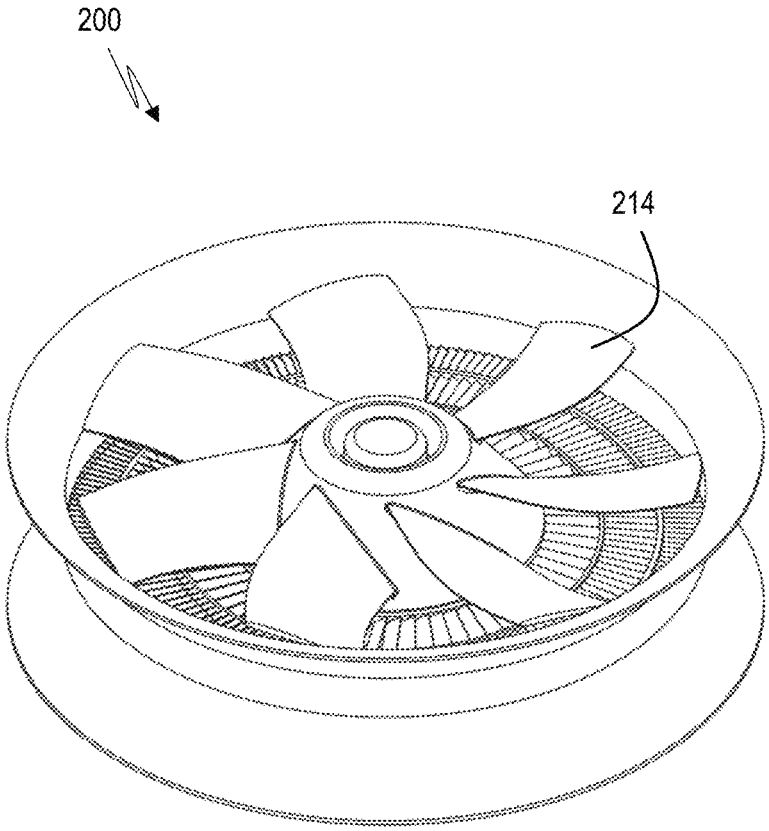
FIG. 6C is a bottom perspective view of another embodiment of a wide-angle vane-diffuser fan assembly according to the present invention.
Figure 6D:
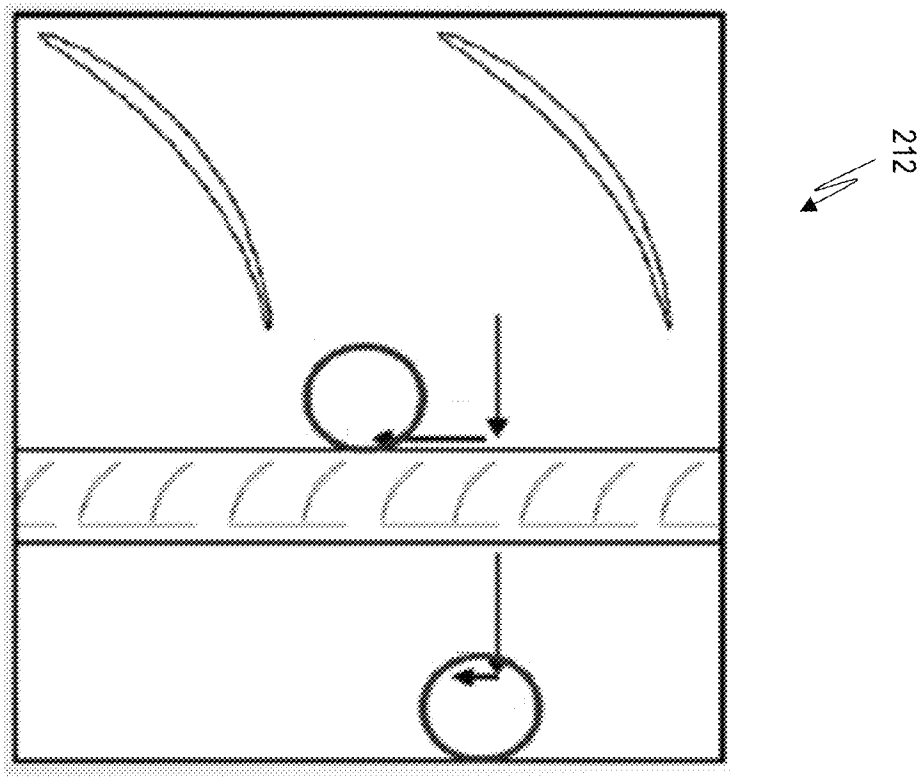
FIG. 6D is a schematic of airflow through the embodiment of a wide-angle vane-diffuser fan assembly of FIG. 6A according to the present invention.

Referring to FIG. 6A through 6C, another embodiment of the present invention is a wide-angle vane-diffuser fan assembly 212 comprised of a mixed-flow fan rotor 214 that is coupled to a combination vane diffuser with integrated heat exchanger 216. A high resistance medium (HRM) 218 (e.g. filter, heat exchanger, etc.) is coupled upstream of vane-diffuser fan assembly 212. Combined vane diffuser and heat exchanger 216 has vanes 220 with integrated micro-channels for heat exchange that performs the functions of de-swirling the flow as well as the function of providing for heat exchange, and thus acts as both a vane diffuser and downstream HRM. This embodiment provides even more compactness, while still providing the benefit of HRMs strongly coupled upstream and downstream of mixed-flow fan rotor 214. Fan assembly 212 could be used with system 10 and system 100.

Figure 9A:
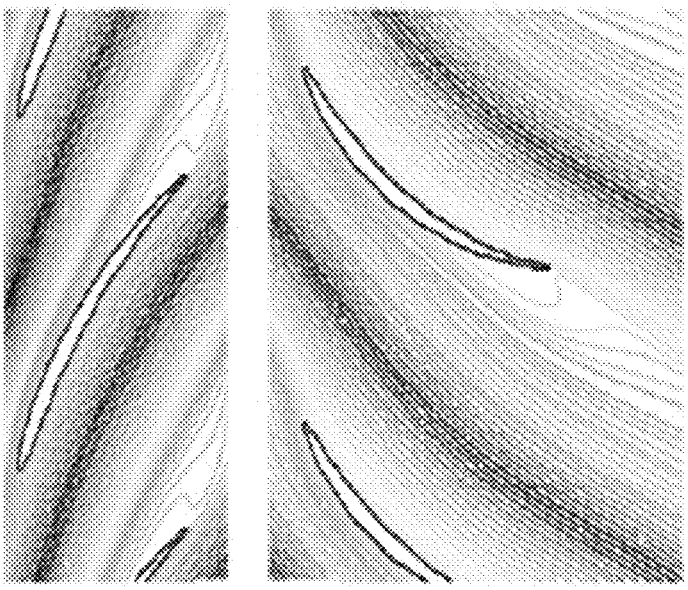
FIG. 9A is a flow simulation of the first embodiment of the present invention without high resistance mediums in place.
Figure 9B:
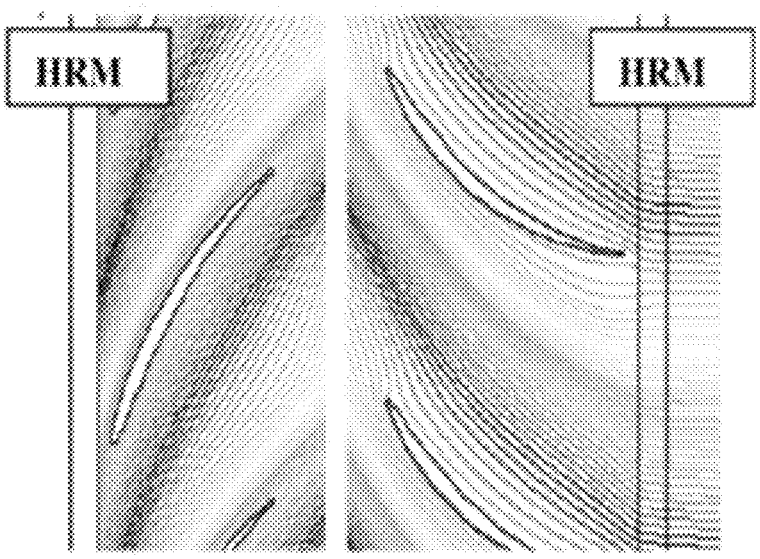
FIG. 9B is a flow simulation of the first embodiment of the present invention with high resistance mediums in place.
Figure 11:
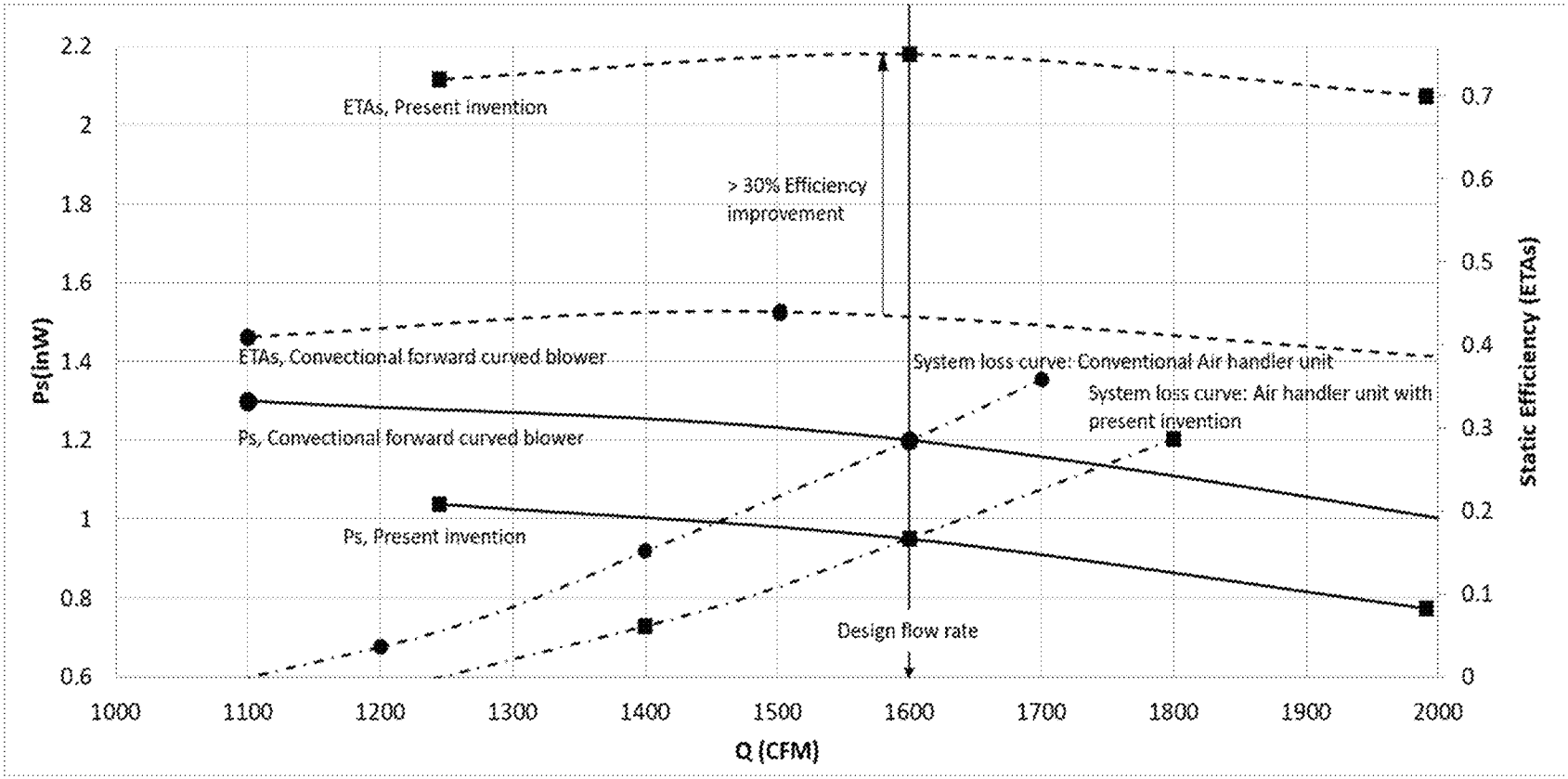
FIG. 11 is a graph of the performance of an air handling unit having a wide-angle vane-diffuser fan assembly according to the present invention.

In all embodiments described above, rotor and stator blades are loaded much higher than with conventional designs (high cambering yielding rotor blades to have a diffusion factor of 0.6 or higher, and stator vanes to have a diffusion factor or 0.8 or higher). In fact, the present invention would stall in the absence of the upstream and downstream HRMs, as evidence from the streamline patterns from 2D CFD results without HRM (FIG. 9A) and with HRM (FIG. 9B) for wide-angle vane-diffuser fan assembly 12. Mixed-flow fan rotor 14 employed in the wide-angle vane-diffuser fan assembly 12 results in a larger rotor inlet flow area to maximize the effectiveness of the upstream HRM while minimizing pressure drop across it. Mixed-flow fan rotor 14 also results in higher work input (or higher pressure rise) to the flow near the fan hub region when compared to conventional axial fan design. The presence of HRM 18 in front of the mixed-flow fan rotor 14 allows for higher blade loading (diffusion factor in the 0.6 range). This is critical, as the flow near the hub region must have enough static pressure to overcome the downstream HRM. An integrated stator/HRM placed behind fan rotor 14 is key aspect of the wide-angle vane-diffuser fan assembly 12. The stator blade region, designated here as the wide-angle vane-diffuser, consists of highly-loaded stator vanes (high diffusion factor in the range of 0.8) placed in a wide-angle linear diffuser. As usual, the function of the stator vanes is to convert the dynamic pressure associated with swirl velocity to useful static pressure. The function of the linear axial diffuser is to convert some of the dynamic pressure associated with the axial velocity component to static pressure. It also allows for the flow to enter the HRM more uniformly and at lower velocity. It is noted that the presence of the downstream HRM allows for the stator vanes to be highly loaded (diffusion factor in the 0.8 range) while the linear axial diffuser can have extreme angle (in the range of 45-degree).

Figure 7A:
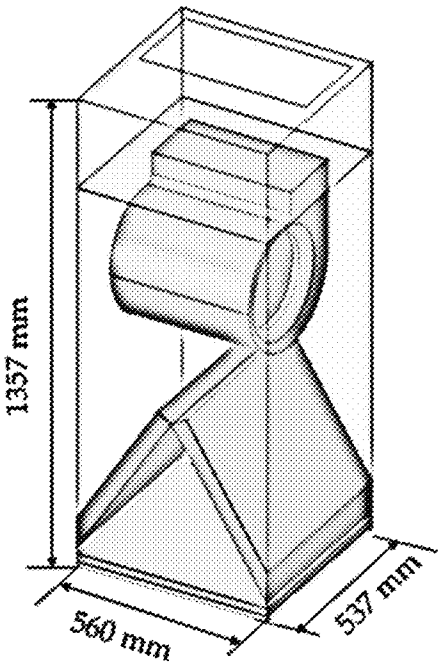
PRIOR ART FIG. 7A
FIG. 7A is a schematic showing a conventional baseline air handler unit.
Figure 7B:
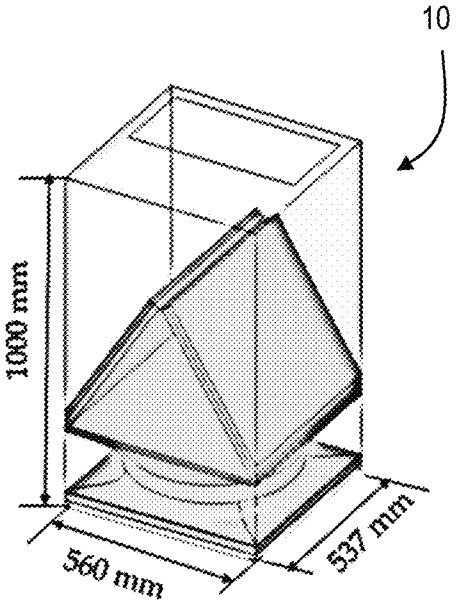
FIG. 7B is a schematic showing the impact of the present invention.
Figure 7C:
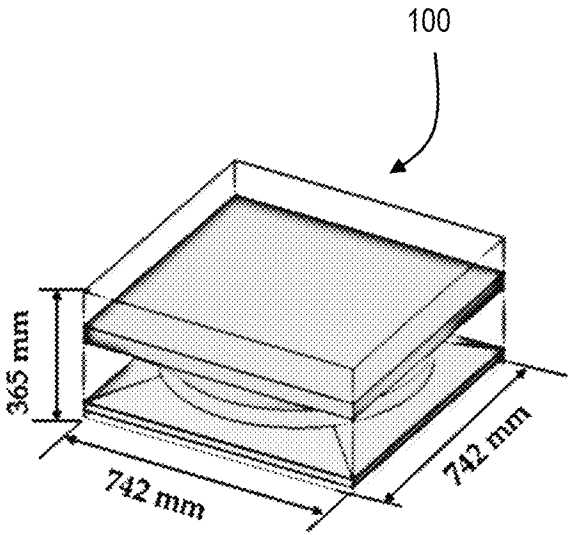
FIG. 7C is another schematic showing the impact of the present invention.

As seen in FIG. 7, a significant benefit of using compact system 10 or compact system 100 in air handler units is that the size of the unit can be reduced dramatically. Even, for the air handler unit with flat coil, the width and the depth of the unit is increased to accommodate the coil size, an air handling unit with compact system 10 or compact system 100 according to the present invention will reduce the size of the air handler units in the range of 30-50% (in volume) compared a conventional air handler unit.

Figure 8A:
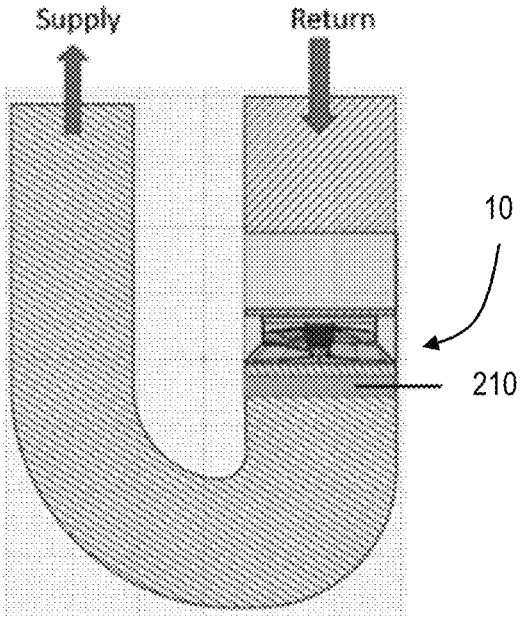
FIG. 8A is a schematic showing a first installation option including condensation management for an air handling unit outfitted according to the present invention.
Figure 8B:
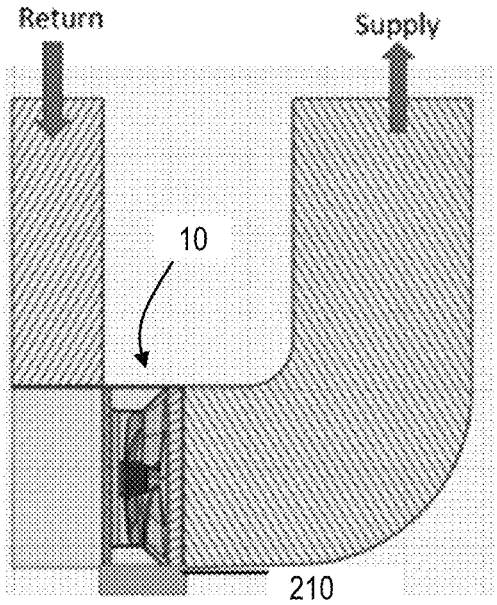
FIG. 8B is a schematic showing a second installation option including condensation management for an air handling unit outfitted according to the present invention.

Installation of air handler units with compact system 10 or 100 and particular condensation management will depend on the residential ducting system. Two options including drain pans 210 are shown in FIG. 8 with a vertical installation (left) or horizontal installation (right) possible. In the latter case, the presence of HRM 18 in front of rotor fan assembly 12 should produce a uniform entrance flow from the 90° turn. For air handler with both 10 or 100, a support system (legs or stands) should be used to keep the fan coil secure.

The forward curved (FC) blowers that are being used in the majority of air handler units on the market today have static efficiency of about 40%. Traditional vane axial fans can operate at maximum static efficiencies up to 60-65%. The fan assembly of FIG. 2 can have maximum static efficiency of 76% or better. In addition, the parasitic loses inside an air handler unit with compact system 10 or compact system 100 according to the present invention are 20% less than the conventional baseline units using FC blowers. This is because the flow path through an air handler unit with wide-angle vane-diffuser fan systems according to the present invention is nearly unidirectional (i.e. no extreme 90-degree turn), and the flow dynamic pressure is kept low to reduce parasitic loss. In contrast, for a baseline air handler unit with FC blower, as the streamline patterns inside the baseline air handler unit colored by velocity magnitude presented in FIG. 10 clearly show, there is a large low-velocity region in the center between the coil and the blower (or region of dead flow), while high-velocity airflows enter the blower through the narrow gap between the wall and the blower intakes, followed by an abrupt 90-degree turn. This results in large parasitic losses (recall that parasitic loss is proportional to the local dynamic pressure). Another significant source of loss present in the baseline design is the large dynamic pressure at the blower outlet (or dump loss). Thus, by replacing a conventional blower fan with wide-angle vane-diffuser fan system 10 or 100 according to the present invention, power reduction on the order of 55% (35% from the fan technology and 20% from the reduction in parasitic losses) is attainable. This reduction in power will also improve the overall efficiency of the system. For example, if the air handler is used for cooling, a 55% reduction in fan power will increase the Seasonal Energy Efficiency Ratio (SEER) by ~4 points. Since most-efficient air handlers on the market have a SEER of around 20, a 4-point increase in SEER can be interpreted as 20% improvement in overall efficiency.

With respect to noise, high efficiency air-movers like vane-axial fans need to run at higher fan speed compared to FC blowers to provide the required duty. Since higher RPM will cause higher noise level, it is important to keep the fan speed as low as possible for acceptable sound level and quality. As wide-angle vane-diffuser fan system 10 or 100 according to the present invention can be used at lower fan speeds, another advantage of the present invention becomes apparent. First, due to significant improvement in fan performance as a result of close coupling between the fan and the HRMs of compact system 10 and compact system 100, the fans will only need to run at moderately high RPMs (~1400 RPM) to deliver the required duty. This result is achieved by increasing airfoil cambering (or blade loading), well beyond the conventional limit. Second, the placement of HRMs upstream and downstream of the fan help deliver a more uniform flow in and out of the fan and thus attenuates sound radiation from the inlet and the outlet of the fan. Thus, compact system 10 and compact system 100 according to the present invention employ high-efficiency vane-diffuser mixed-flow fans while having an acceptable sound level and quality.

In compact system 10 or compact system 100 according to the present invention, the wide-angle vane-diffuser fan assembly and HRMs (filter and coils) may be configured as a subassembly that can easily be removed from the air handler unit. Thus, when maintenance or cleaning is needed on any component (such as the fan, vane diffuser, motor, coil, or filter), the subsystem may be removed and cleaning/maintenance easily be performed. It should be noted that because of the strong flow-interaction between the fan and the HRMs, the resulting wider stall margin of the compact HRM and wide-angle vane-diffuser fan assembly allows for longer maintenance period. In particular, when the coil or filter flow resistance increases (due to accumulation of dirt on the coil and filter), the fan can still operate more efficiently than conventional systems at the lower flow rates.

Another very important benefit of compact system 10 or compact system 100 according to the present invention is a superiority over forward curved blowers with respect to susceptibility to damage or corrosion. Forward curved fans are made of sheet-metal which is susceptible to corrosion. They may also become bent or damaged easily during handling and transportation. For compact system 10 or compact system 100 according to the present invention, the rotor and the stator blades of compact system 10 may be injection molded from 5VA glass filled nylon with fire retardant as up to 10 square feet of 5VA plastic with fire retardant additives are allowed for used in air handlers as specified by Underwriters Laboratories (UL). Obviously, plastic has no corrosion issue, and glass filled nylon also has good impact resistance. For example, components made form glass-filled nylon can be dropped from a height of three feet with no damage.

As mentioned above, for compact system 10, injection molding may be used to manufacture both the rotor and the stator from 5VA glass filled nylon with fire retardant. Although the price of the injection molded rotor and stator assembly will be higher than the price of a forward curved blower, the increase in cost may be offset by the cost reduction due to significant decrease in the size of the air handler unit in which compact system 10 and 100 are installed. When shipping and handling costs are included, an air handler unit with compact system 10 or compact system 100 may even be more cost effective than conventional systems. In addition, because of the increase in flow speed and flow uniformity through the smaller heat exchanger, it is anticipated that the heat exchanger will be more efficient. Therefore, the number of coil-rows will be reduced, which is another cost benefit. For compact system 100, combination vane diffuser and integrated heat exchanger 116 is not an off-the-shelf component and thus must be specially manufactured, the price of compact system 100 may initially be higher than conventional systems.

What is claimed is:

1. A compact assembly for an air handling unit, comprising:

a mixed-flow fan having a rotor with a plurality of blades to move air from an upstream side of the mixed-flow fan to a downstream side, wherein the mixed flow fan has a diffusion factor of at least 0.6;

a wide-angle diffuser having a hub-to-tip ratio below 0.5, a diffusion factor of at least 0.6, and a plurality of vanes coupled to the downstream side of the mixed-flow fan;

a first high resistance media coupled directly to the upstream side of the mixed-flow fan and positioned no farther from the plurality of blades than fifteen percent of a mean chord of the plurality of blades; and a second high resistance media coupled directly to the wide-angle diffuser and positioned no farther from the plurality of vanes than a five percent of a mean chord of the plurality of vanes.

2. The compact assembly of claim 1, wherein the diffuser has up to a 45 degree diffuser angle.

3. The compact assembly of claim 1, wherein the diffuser has a hub with a variable diameter.

4. The compact assembly of claim 1, wherein the mixed-flow fan has a hub with a variable diameter.

5. The compact assembly of claim 1, wherein the first high resistance media is selected from the group consisting of a filter and a heat exchanger.

6. The compact assembly of claim 1, wherein the second high resistance media comprises a heat exchanger.

7. The compact assembly of claim 6, wherein the heat exchanger is incorporated into the plurality of vanes of the diffuser.

8. The compact assembly of claim 1, wherein the second high resistance media is incorporated into the plurality of vanes of the diffuser.

* * * * *